United States Patent [19]

Nameche

[11] 4,018,301

[45] Apr. 19, 1977

[54] CLAMP TYPE LADDER WALL ENGAGING BRACKET

[76] Inventor: Alfred E. Nameche, 407 N. West St., Lima, Ohio 45801

[22] Filed: July 27, 1976

[21] Appl. No.: 709,164

[52] U.S. Cl. ..... 182/206; 182/93

[51] Int. Cl.[2] ..... E06C 1/36; E06C 7/48

[58] Field of Search ..... 182/206, 214, 93, 108, 182/107; 248/210, 226 C

[56] References Cited

UNITED STATES PATENTS

| | | | |
|---|---|---|---|
| 3,028,929 | 4/1962 | Chubbs | 182/206 |
| 3,603,431 | 9/1971 | Nameche | 182/206 |
| 3,910,380 | 10/1975 | Nameche | 182/206 |

FOREIGN PATENTS OR APPLICATIONS

| | | | |
|---|---|---|---|
| 1,118,135 | 3/1956 | France | 182/93 |
| 228,404 | 11/1910 | Germany | 182/93 |

*Primary Examiner*—Reinaldo P. Machado
*Attorney, Agent, or Firm*—Clarence A. O'Brien; Harvey B. Jacobson

[57] ABSTRACT

A support arm structure for the upper end of a ladder is provided and includes mounting structure for mounting one end of the support arm structure on the upper end of the ladder for swinging of the support arm structure about a transverse axis extending transversely of the associated ladder, the support arm structure being swingable in a plane in which the ladder is disposed. The outer end portion of the support arm structure includes relatively pivotable opposing jaw structures and a connecting link is connected between the jaw structures and a portion of the mounting structure stationary with the ladder whereby the connecting link may effect relative oscillation of the jaws toward and away from each other in response to swinging movement of the support arm structure relative to the ladder. In addition, the connecting link and its connection with the ladder includes structure whereby the effective length of the connecting link may be varied to thereby adapt the opposing jaws to clampingly engage objects of different size therebetween.

7 Claims, 3 Drawing Figures

CLAMP TYPE LADDER WALL ENGAGING BRACKET

BACKGROUND OF THE INVENTION

This invention comprises an improvement over the ladder and support brackets disclosed in my prior U.S. Pat. Nos. 3,603,431 and 3,910,380.

Various types of ladder support brackets have been heretofore designed for engaging a supportive structure against which the upper end of the ladder is to be leaned and maintaining the upper end of the ladder in spaced relation relative to the supportive structure. In addition, some of these ladder support brackets, such as those disclosed in the above-mentioned prior patents, have included clamp means at the free ends thereof for clampingly engaging the associated supportive structure. However, these clamp means have not been designed so as to be readily adaptable to clampingly engage various configurations of supportive structures and supportive structures of different sizes.

BRIEF DESCRIPTION OF THE INVENTION

The ladder support bracket of the instant invention includes support arm structure pivotally supported from the associated ladder and equipped with relatively pivotable jaws and a connecting link operatively connected between the relatively pivotable jaws and the ladder whereby movement of the jaws toward and away from each other may be effected by oscillation of the support arm structure relative to the associated ladder. The connecting link and the structure by which the connecting link is connected to the associated ladder includes structure whereby the effective length of the connecting link may be varied and the opposing jaws may thus be adjusted to engage supportive structures of different sizes.

The main object of this invention is to provide a ladder support bracket for use on single section ladders as well as extension ladders and which will be capable of clampingly engaging a supportive structure for the ladder and supporting the upper end of the ladder in spaced relation relative to the supportive structure therefor.

Another object of this invention, in accordance with the immediately preceding object, is to provide a ladder support bracket which may be automatically clampingly engaged with a supportive structure as the associated ladder is erected and prior to a person climbing the associated ladder.

Still another object of this invention is to provide a support bracket for a ladder constructed in a manner whereby it may be readily removably attached to substantially all types of ladders.

Another very important object of this invention is to provide a support bracket for a ladder including adjustment means whereby the clamping jaws thereof may be adjusted in order to accommodate supportive structures of different sizes.

A final object of this invention to be specifically enumerated herein is to provide a support bracket for a ladder in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings, the numeral 10 generally designates a conventional form of ladder including a pair of opposite side rails 12 (only one of which is shown) and a plurality of spaced rungs 14 extenting and secured between the side rails 12.

Figure 1:
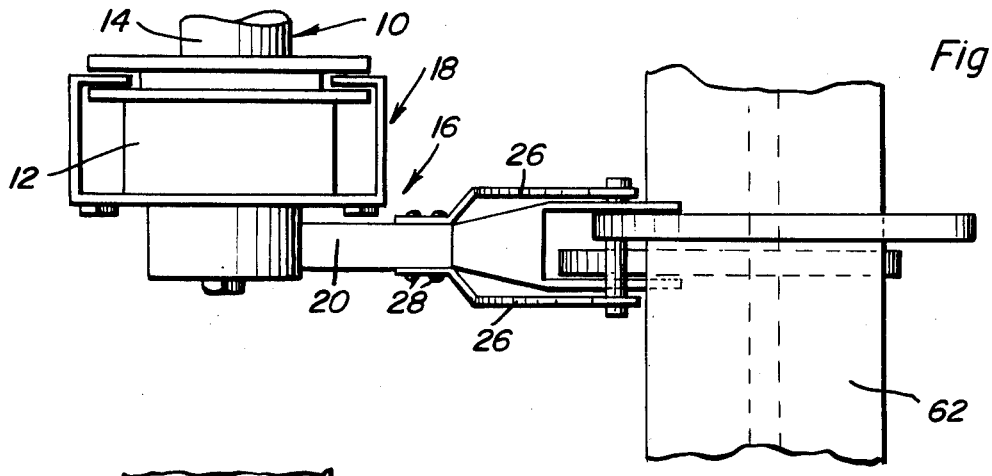
FIG. 1 is a fragmentary top plan view of a ladder and an adjacent supportive structure with the support engaging bracket of the instant invention operatively connected between the ladder and the supportive structure.
Figure 2:
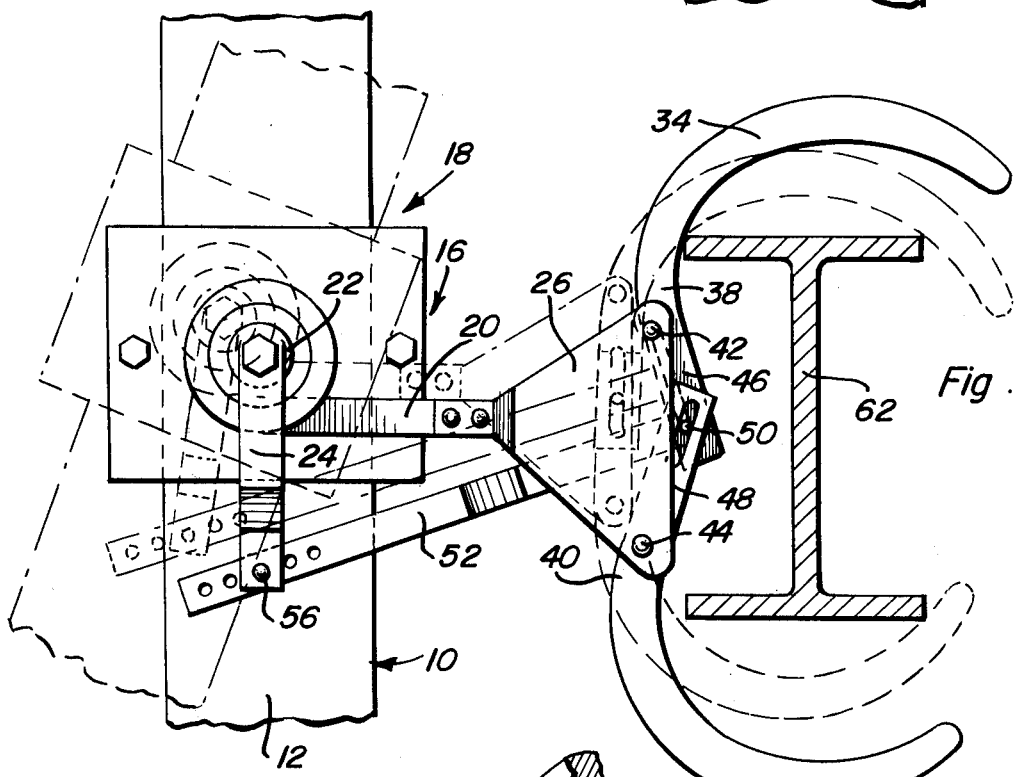
FIG. 2 is a fragmentary side elevational view of the assemblage illustrated in FIG. 1 and with an alternate position of the ladder illustrated in phantom lines.
Figure 3:
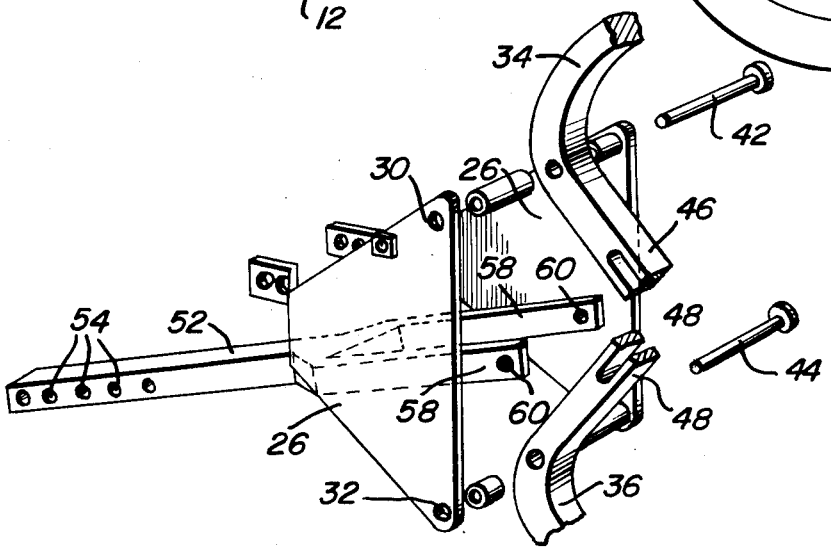
FIG. 3 is a fragmentary exploded perspective view of the jaw supporting structure and connecting link structure of the support bracket.

The support arm structure of the instant invention includes a pair of assemblies (only one of which is shown) referred to in general by the reference numeral 16. Each assembly 16 is mounted on a corresponding side rail 12 by means of a mounting bracket referred to in general by the reference numeral 18 corresponding to the similar components disclosed in my above-mentioned prior U.S. patents. Each bracket 18 has a support arm structure 20 pivotally supported therefrom by means of a pivot connection 22 and an anchor arm 24 is supported from each bracket 18 in stationary position relative to the corresponding side rail. Further, each support arm 20 is spring-biased in a clockwise direction as viewed in FIG. 2 in the same manner as that disclosed in my prior U.S. Pat. No. 3,603,431.

The outer end of each support arm structure 20 has a pair of mounting plates 26 secured thereto by means of suitable fasteners 28 and the plates 26 project endwise outwardly beyond the outer end of the corresponding support arm structure 20 and include upper and lower apertures 30 and 32 formed therethrough. The plates 26 receive the outer end of the support arm structure 20 therebetween and a pair of crescent-shaped opposing jaws 34 and 36 have their base and portions 38 and 40 pivotally secured between the outer ends of the plates 26 by means of fasteners 42 and 44 secured through the apertures 30 and 32, respectively. The base end portions of the jaws 34 and 36 are received between the outer ends of the plates 26 and the base end portions 38 and 40 include longitudinally slotted terminal ends 46 and 48 connected together in overlapped relation by means of a slide pin 50 secured therethrough.

An elongated connecting link 52 is provided and includes a plurality of longitudinally spaced bores 54 on one end thereof by which the end of the connecting link 52 may be secured to the free end of the anchor arm 24 by means of a fastener 56 secured through the free bifurcated end of the anchor arm 24 and one of the bores 54 formed through the connecting link 52, the bored end of the connecting link 52 being received between the furcations of the free end of the anchor arm 24.

The end of the connecting link 52 remote from the bores 54 is bifurcated and includes a pair of spaced furcations 58 provided with transverse bores 60 at their free ends. The bores 60 receive the opposite ends of the pin 50 therethrough and it may be seen that the crescent-shaped jaws 34 and 36 may be relatively oscillated between the plates 26 upon reciprocation of the connecting link 52.

In operation, the pivot fasteners 56 of the assemblies 16 may be secured through corresponding selected bores 54 in order to determine the maximum opening and closing of the jaws 34 and 36. Then, the ladder 10 may be disposed in an upright position such as that illustrated in solid lines in FIG. 2 of the drawings with the jaws 34 and 36 displaced away from each other. Thereafter, the ladder 10 may be advanced toward a suitable supportive structure such as the I beam 62 in FIG. 2 and the ladder 10 may then be inclined to the position thereof illustrated in phantom lines in FIG. 2 of the drawings whereby angular displacement of the support arm structures 20 relative to the ladder 10 will cause a pull to be effected upon the connecting links 52 by the anchor arms 24 and the jaws 34 and 36 to be swung toward each other to the phantom line position thereof illustrated in FIG. 2 tightly clampingly engaging the supportive structure 62. Of course, when it is desired to remove the ladder 10 from the supportive structure 62, the ladder 10 is returned from the inclined position thereof illustrated in phantom lines in FIG. 2 to the upright position thereof illustrated in solid lines in FIG. 2 in order that the jaws 34 and 36 may swing from the phantom line positions to the solid line positions of FIG. 2 and thus be readily disengaged from the supportive structure 62.

It may thus be seen that the clamp structures defined by the pairs of jaws 34 and 36 carried by the support arm assemblies 16 may be actuated in substantially the same manner as the jaw assemblies carried by the corresponding support arm structures disclosed in my above-mentioned prior U.S. patents. However, the connecting links 52, by being provided with the longitudinal spaced transverse bores 54 formed therethrough, enable initial adjustment of the jaws 34 and 36 to be carried out whereby angulation of the ladder 10 to an inclined position thereof such as that illustrated in FIG. 2 of the drawings in phantom lines will enable the jaws 34 and 36 to tightly clampingly engage supportive structures of different sizes.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A ladder support bracket assembly, said assembly including elongated support arm means, mounting means for attachment to the upper end of a ladder to be leaned toward and supported from a support structure, said mounting means including pivot means pivotally supporting one end of said support arm means from said mounting means for swinging about a horizontal axis, said mounting means including mounting structure for support from an associated ladder including opposite side rails with said horizontal axis extending transversely of said rails and generally paralleling a plane containing said rails, the free end portion of said arm means including first and second jaw means shiftably supported from said arm means for movement relative thereto toward and away from each other to clamp said support structure therebetween, link means operatively connected to said jaw means at one end and adapted for connection with said ladder at the other end for shifting said jaw relative to said support arm means in response to swinging oscillation of said support arm means relative to said mounting means.

2. The combination of claim 1 wherein said jaw means project endwise outwardly from the outer end portion of said support arm means and open toward each other.

3. The combination of claim 1 wherein said link means includes means operative to adjust the effective length thereof.

4. In combination, an upstanding inclined ladder including opposite side longitudinal rails, elongated support arm structure pivotally supported at one end portion thereof from the upper end of said ladder with the free end of said support arm structure projecting outwardly from the side of said ladder facing in the direction in which the ladder is inclined and for oscillation of said support arm means about a horizontal axis extending transversely of said ladder, first and second jaw means carried by the free end portion of said support arm structure and supported therefrom for shifting relative thereto toward and away from each other, elongated link means connected between said jaw means and said ladder for shifting said second jaw means relative to said support arm structure toward and away from each other in response to upward and downward swinging, respectively, of the free end portion of said support arm structure relative to said ladder.

5. The combination of claim 6 wherein said link means includes means operative to vary the effective length of said link means.

6. The combination of claim 1 including a pair of side plates secured to opposite sides of and projecting outwardly from said free end portion of said arm means, said plates being generally normal to said axis, said first and second jaw means comprising downwardly and upwardly opening upper and lower C-shaped jaw members, respectively, one pair of corresponding ends of said jaw members having longitudinal slots formed therein and disposed in laterally overlapped relation with an anchor pin paralleling said axis extending through and slidably received in said slots, said overlapped ends being received between said plates and pivotally supported therefrom for oscillation about parallel axes generally paralleling said axis and extending transversely of said jaw members and spaced therealong from said slots, said link means, at said one end thereof, being bifurcated with said overlapped ends of said jaw members received between the furcations thereof and the opposite ends of said anchor pin anchored relative to said furcations.

7. The combination of claim 6 wherein the other end of said link means including longitudinally spaced transverse bores formed therethrough for pivotal anchoring relative to said ladder at a selected point spaced along said link means.

* * * * *